US009566466B2

(12) United States Patent
Huang et al.

(10) Patent No.: US 9,566,466 B2
(45) Date of Patent: Feb. 14, 2017

(54) EXERCISE DEVICE

(71) Applicant: Dyaco International Inc., Taipei (TW)

(72) Inventors: Hsuan-Fu Huang, Taipei (TW); Han-Lin Liu, Taipei (TW)

(73) Assignee: Dyaco International Inc., Taipei (TW)

( * ) Notice: Subject to any disclaimer, the term of this patent is extended or adjusted under 35 U.S.C. 154(b) by 0 days.

(21) Appl. No.: 14/703,817

(22) Filed: May 4, 2015

(65) Prior Publication Data

US 2016/0263431 A1 Sep. 15, 2016

(30) Foreign Application Priority Data

Mar. 9, 2015 (TW) ..... 104107447 A

(51) Int. Cl.

| | |
|---|---|
| ***A63B 22/04*** | (2006.01) |
| ***A63B 22/00*** | (2006.01) |
| *A63B 22/06* | (2006.01) |
| *A63B 21/22* | (2006.01) |

(52) U.S. Cl.

CPC ..... *A63B 22/04* (2013.01); *A63B 22/0056* (2013.01); *A63B 21/225* (2013.01); *A63B 22/0015* (2013.01); *A63B 2022/0682* (2013.01)

(58) Field of Classification Search

CPC . A63B 22/04; A63B 22/0025; A63B 22/0046; A63B 22/06; A63B 22/0664; A63B 22/20; A63B 2022/0038; A63B 22/0056; A63B 22/0015; A63B 2022/0682; A63B 21/0225

See application file for complete search history.

(56) References Cited

U.S. PATENT DOCUMENTS

| | | | | |
|---|---|---|---|---|
| 6,422,977 | B1 * | 7/2002 | Eschenbach | A63B 22/001 482/51 |
| 6,440,042 | B2 * | 8/2002 | Eschenbach | A63B 22/001 482/51 |
| 7,223,209 | B2 * | 5/2007 | Lee | A63B 22/001 482/52 |
| 7,238,146 | B1 * | 7/2007 | Chen | A63B 22/001 482/52 |

(Continued)

FOREIGN PATENT DOCUMENTS

| | | |
|---|---|---|
| TW | 201336553 A | 9/2013 |
| TW | 201336554 A | 9/2013 |

*Primary Examiner* — Loan H Thanh
*Assistant Examiner* — Megan Anderson
(74) *Attorney, Agent, or Firm* — Donald E. Stout; Stout, Uxa & Buyan, LLP

(57) ABSTRACT

An exercise device is provided with a frame, two pedals, two first swing arms, two second swing arms, a resistance device, two link rods, two cranks, two limiting rods, and two roller assemblies. Each first swing arm has two ends, in which one end pivotally connects to the frame, and the other connects to one of the two second swing arms. Each second swing arm has two ends, in which one end connects to one first swing arm, and the other connects to one pedal. The resistance device has an axle. Each crank includes two ends, one end connecting to the axle, and the other connecting to one link rod. Each link rods includes two ends, one end connecting to one crank, and the other connecting to an area of one second swing arm. Each roller assembly connects to one second swing arm, and can slide along one limiting rod.

8 Claims, 8 Drawing Sheets

(56) References Cited

U.S. PATENT DOCUMENTS

| | | | | |
|---|---|---|---|---|
| 8,376,913 | B2 * | 2/2013 | Lee | A63B 22/001 482/52 |
| 8,979,713 | B2 * | 3/2015 | Huang | A63B 22/04 482/51 |
| 9,050,485 | B2 * | 6/2015 | Huang | A63B 22/001 |
| 9,199,115 | B2 * | 12/2015 | Yim | A63B 23/03516 |
| 9,259,610 | B2 * | 2/2016 | Huang | A63B 21/225 |
| 2012/0077645 | A1 | 3/2012 | Lee et al. | |
| 2013/0237379 | A1 * | 9/2013 | Huang | A63B 22/001 482/52 |
| 2014/0121070 | A1 * | 5/2014 | Ellis | A63B 21/159 482/96 |

* cited by examiner

EXERCISE DEVICE

CROSS-REFERENCE TO RELATED APPLICATIONS

The entire contents of Taiwan Patent Application No. 104107447, filed on Mar. 9, 2015, from which this application claims priority, are expressly incorporated herein by reference.

BACKGROUND OF THE INVENTION

1. Field of the Invention

The present invention relates to an exercise device, and more particularly relates to an exercise device providing ergonomic paths.

2. Description of Related Art

Without limiting the disclosed embodiments, a stair stepper, is an exercise device to elevate the heart rate, burn calories and improve cardiovascular endurance.

On a typical stair stepper, a user stands on two platforms supported by a given level of resistance. The user lifts alternating feet, as if walking up a set of stairs, so as to build muscle in legs and gluteus. The stair stepper is also a lower-impact training machine compared to a treadmill, making it useful for those with leg injuries. However, the stair stepper should be used with caution because inadequately activating will place additional stress on the knees.

FIG. 1A and FIG. 1B show two conventional stair steppers. FIG. 1 shows a convention stair stepper with an axis 21 and a pedal 20 coupling with the axis 21 via a rod 22, so that the pedal 20 moves along a path P. FIG. 2 shows another conventional stair stepper with two axis 21 and a pedal 20 coupling with the two axes 21 via two rods 22, so that the pedal 20 moves along a path P. Noticed that the both paths P are an arc with a center pointing away the user, and the paths P are not ergonomic and thus cannot simulate the real stepping, striding, or stair-climbing.

US patent US20120077645 discloses a stair stepper, in which the crank arm exerts force to the linking units, so that the pedal link coupled with the linking units can be moved forward and backward. Each pedal link has a rollable anti-friction member to pivotally couple with the pedal. When the pedal link is moved forward, the rollable anti-friction member drags the pedal climbing forwardly and upwardly along the ramp rod. However, the climbing force of the pedals is unsufficient, and thus the design is not a good solution to simulate stepping, striding, or stair-climbing.

The mechanism of conventional steppers can also refer to Taiwan patent I458519, entitled "adjustable stepper," and Taiwan patent I442955, entitled "stepper," the entire contents of the foregoing applications are incorporated herein for reference.

In addition, conventional steppers typically suffer from a "dead point" problem. The dead point is a point that when a crank and a link of a linking mechanism are operated to be overlapped, it is difficult to further move the crank.

SUMMARY OF THE INVENTION

In one general aspect, the present invention relates to an exercise device having ergonomic paths and being designed to overcome the "dead point" problem.

In an embodiment of the present invention, an exercise device is provided with a frame, two pedals, two first swing arms, two second swing arms, a resistance device, two link rods, two cranks, two limiting rods, and two roller assemblies. The two pedals enable force to be applied. The two first swing arms are respectively arranged at a side of the frame. The two second swing arms are respectively arranged at a side of the frame, and both first swing arms and both second swing arms have two ends, a first end and a second end, in which the first end of the first swing arm pivotally couples to the frame, and the second end of the first swing arm couples to the first end of a corresponded second swing arm of the two second swing arms, and the second end of the corresponded second swing arm couples to a corresponded pedal of the two pedals. The resistance device comprises an axle and provides a resistance. The two cranks are respectively arranged at a side of the resistance device, and both cranks and both link rods have two ends, a first end and a second end, in which the first end of each crank couples to the axle, and the second end of each crank couples to a first end of a corresponded link rod of the two link rods, and the second end of the corresponded link rod couples to a portion of a corresponded second swing arm of the two second swing arms. Each limiting rod has two ends coupling to the frame. Each roller assembly couples to a corresponded second swing arm of the two second swing arm and slidably couples to a corresponded limiting rod of the two limiting rods.

DETAILED DESCRIPTION OF THE PREFERRED EMBODIMENT

Figure 1A:
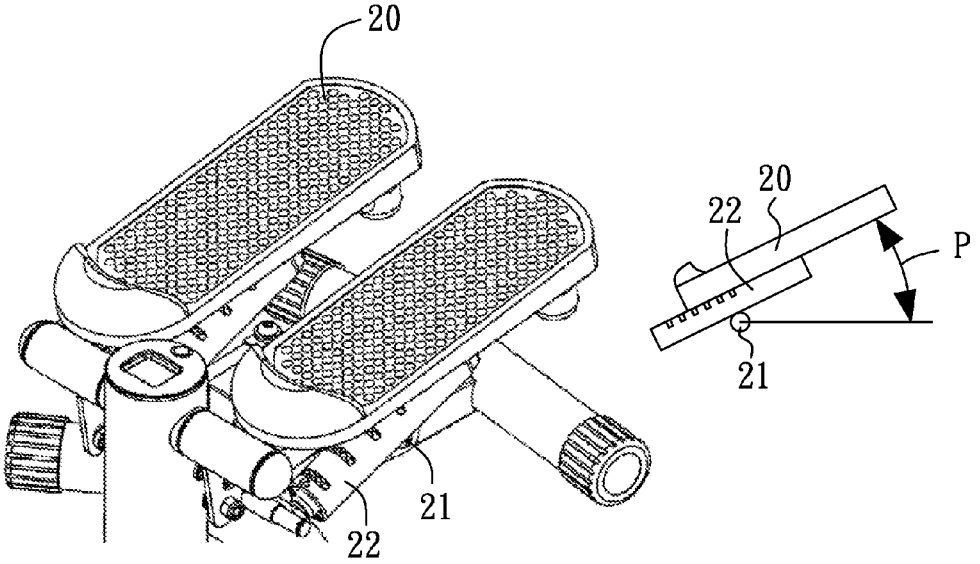
FIG.1A(Prior Art)
FIGS. 1A and 1B show two conventional stair steppers and their moving tracks.

Embodiments of the invention are now described and illustrated in the accompanying drawings, instances of which are to be interpreted to be to scale in some implementations while in other implementations, for each instance, not. In certain aspects, use of like or the same reference designators in the drawings and description refers to the same, similar or analogous components and/or elements, while according to other implementations the same use should not. According to certain implementations, use of directional terms, such as, top, bottom, left, right, up, down, over, above, below, beneath, rear, front, clockwise, and counterclockwise, are to be construed literally, while in other implementations the same use should not. While the invention will be described in conjunction with these specific embodiments, it will be understood that it is not intended to limit the invention to these embodiments. On the contrary, it is intended to cover alternatives, modifications, and equivalents as may be included within the spirit and scope of the invention as defined by the appended claims. In the following description, numerous specific details are set forth in order to provide a thorough understanding of the present invention. The present invention may be practiced without some or all of these specific details. In other instances, well-known process operations and components are not described in detail in order not to unnecessarily obscure the present invention. While drawings are illustrated in detail, it is appreciated that the quantity of the disclosed components may be greater or less than that disclosed, except where expressly restricting the amount of the components.

Figure 2:
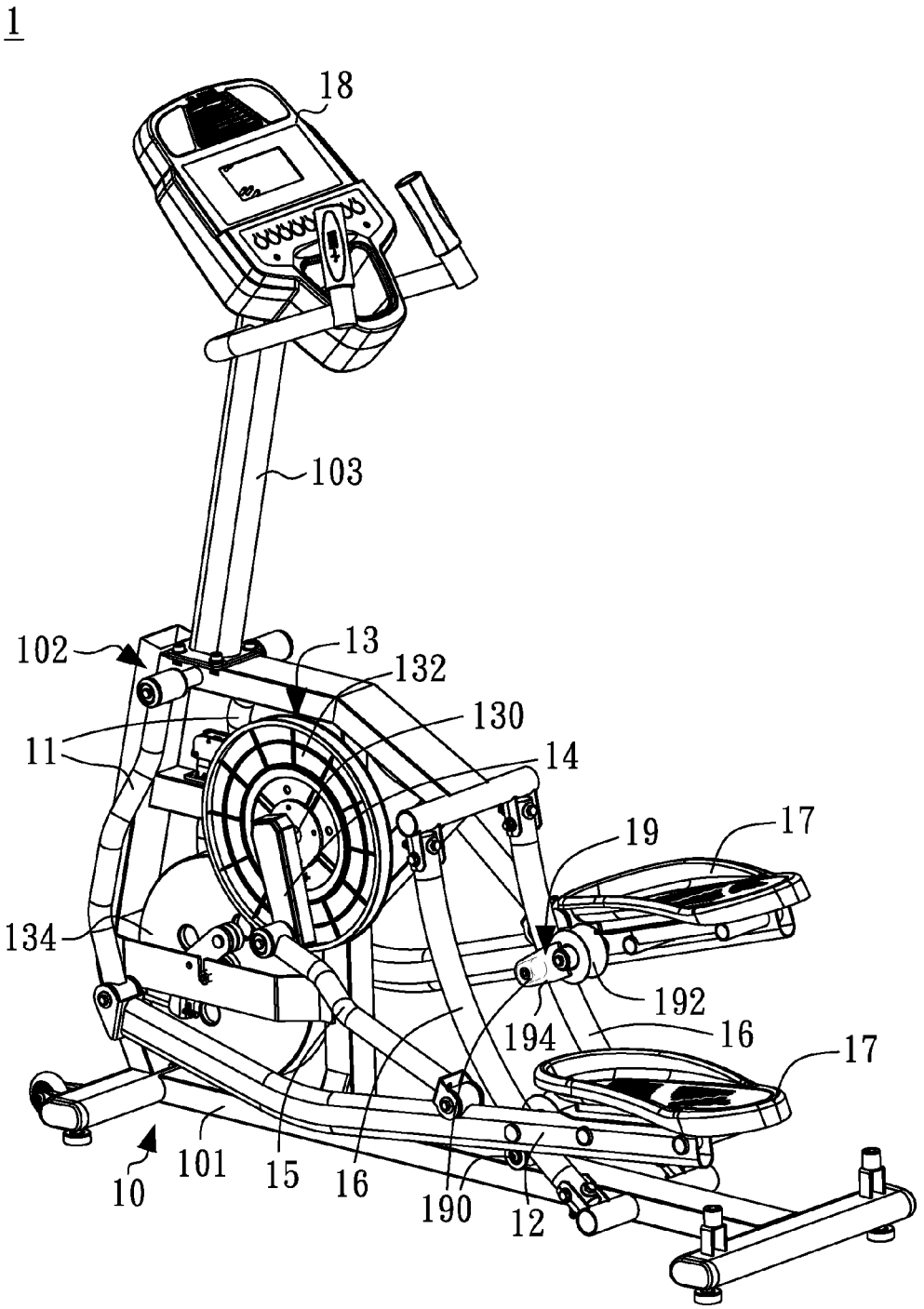
FIG. 2 is a perspective view showing an exercise device according to a preferred embodiment of the present invention.

FIG. 2 shows an exercise device 1 according to a preferred embodiment of the present invention. The exercise device 1 comprises a frame 10, two first swing arms 11, two second swing arms 12, a resistance device 13, two cranks 14, two link rods 15, two limiting rods 16, and two pedals 17.

Referring to FIG. 2, both the two first swing arms 11 and the two second swing arms 12 are respectively arranged at a side of the frame 10. Each first swing arm 11 comprises two ends, in which one end pivotally couples to the frame 10, and the other end pivotally couples to an end of a corresponded second swing arm 12. And the other end of the corresponded second swing arm 12 couples to a corresponded pedal 17. In this preferred embodiment, the frame 10 may comprise, but is not limited to, a base 101, a supporting structure 102, and a post 103. The base 101 is placed on a supporting plane or ground. The supporting structure 102 is arranged on the base 101, and the post 103 is arranged on the supporting structure 102. In this preferred embodiment, one end of the post 103 couples to the supporting structure 102, and the other end of the post 103 couples to an operating interface 18 allowing the user to control the exercise device 1.

Referring to FIG. 2, the two cranks 14 are respectively arranged at a side of the resistance device 13. The resistance device 13 comprises an axle 130, and each crank 14 includes two ends, in which one end couples to the axle 130, and the other end pivotally couples to an end of one corresponded link rod 15. And the other end of the corresponded link rod 15 couples or pivotally couples to a portion, e.g., a middle portion, of one corresponded second swing arm 12. In addition, the two limiting rods 16 may couple or fix with the frame 10. In this preferred embodiment, each limiting rod 16 includes two ends, in which one end couples to the supporting structure 102, and the other end couples with the base 101.

Referring to FIG. 2, preferably the exercise device 1 further comprises two roller assemblies 19. Each roller assembly 19 comprises a front roller 190 and a rear roller 192, and the axis of the rear roller 192 pivotally couples with one of two second swing arms 12. The front roller 190 and the rear roller 192 may be arranged at the front and rear of the limiting rod 16, and are configured to fit the limiting rod 16. Preferably, both the front roller 190 and the rear roller 192 have a recess to fit the limiting rod 16.

Figure 8:
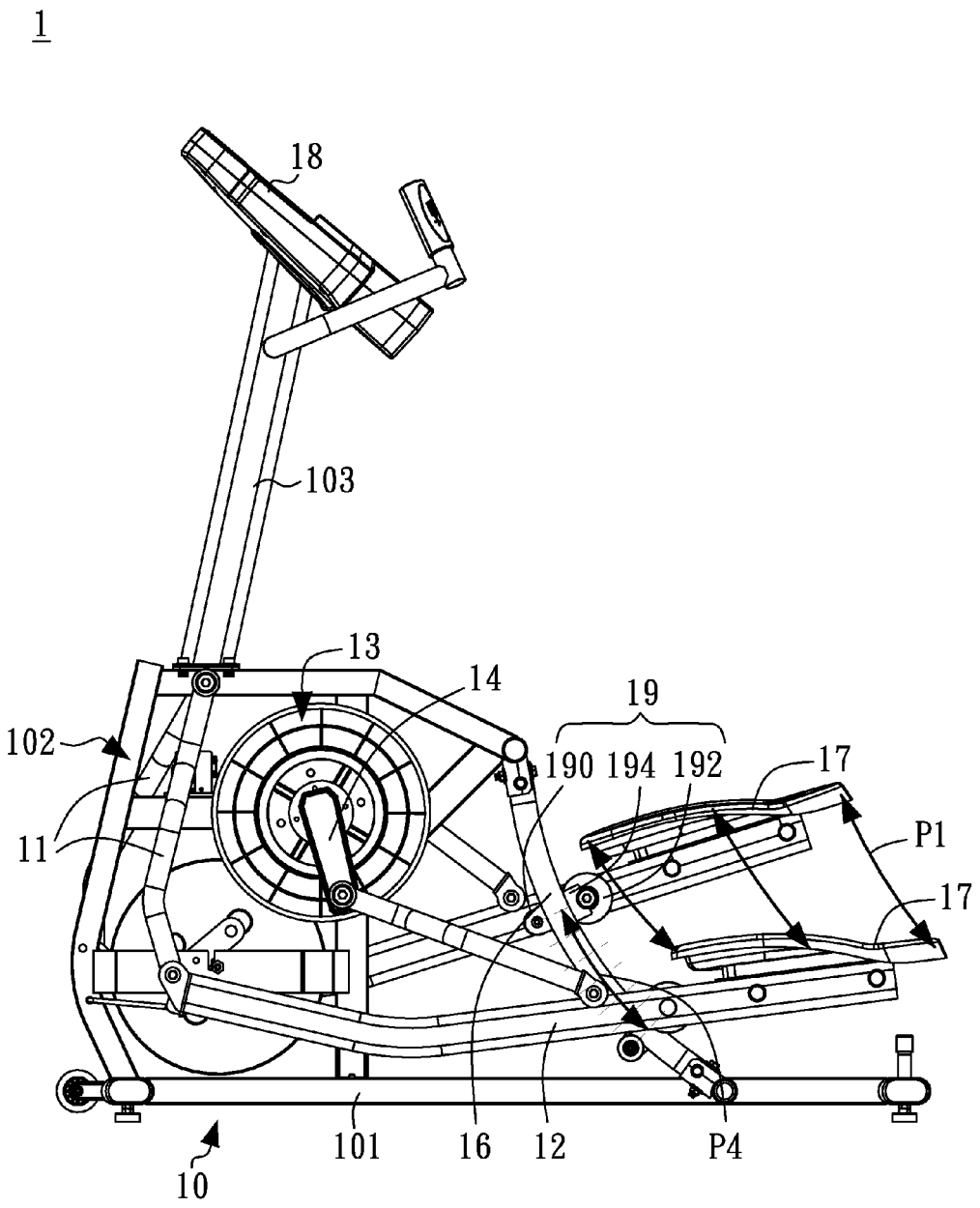
FIG. 8 is a side view showing the operation of the exercise device of FIG. 1.

In addition, each roller assembly 19 may comprise a board structure 194 to fix the front roller 190 and the second roller 192. In particular, the front roller 190 pivotally couples with the board structure 194, the rear roller 192 pivotally couples with the second swing arm 12 and the board structure 194, and the size of the rear roller 192 may be smaller than the size of the front roller 190. By doing so, the front roller 190 and the rear roller 192 can be tightly against the limiting rod 16, and each pedal 17 can be moved along a path defined by the corresponded limiting rod 16. FIG. 8 shows that the roller assembly 19 has a moving path P4 and drags the pedal 17 moving along an arc-shaped moving path P1.

Furthermore, the inclination of the roller assembly 19 is adjustable and therefore the inclination of the pedal 17 is also adjustable due to connection with the roller assembly 19. In detail, when the pedal 17 is moved to the lowest position, the rear portion of the pedal 17 will be lifted a bit or the whole pedal 17 is near horizontal. When the pedal 17 is moved to the highest position, the rear portion of the pedal 17 will be lifted considerably. That is, the inclination of the pedal 17 at the lowest position is smaller the inclination of the pedal 17 at the highest position. This moving path is quite ergonomic for simulating stepping, striding, or stair-climbing, and therefore the user can operate the exercise devise easily and safely. When the roller assembly 19 is moved to the highest position, the degree of the inclination of the roller assembly is small; when the roller assembly 19 is moved to the lowest position, the degree of the inclination of the roller assembly is large. That is, the inclination of the roller assembly 19 at the lowest position is greater the inclination of the roller assembly 19 at the highest position. Accordingly, the roller assembly 19 can stabilize the motion of the pedal 17. The pedals 17 will not deviate from the limiting rods 16 when they are operated fast.

Referring to FIG. 2, when a user stands on two pedals 17, a resistance is given by the resistance device 13. The operating interface 18 mounted above the frame 10 can determine the resistance. In this preferred embodiment, the resistance device 13 may comprise, but is not limited to, a driving wheel 132 and a flywheel 134. The driving wheel 132 has an axle 130 with bidirectional bearing (not shown) coupling an end of the two cranks 14. The motion of the pedals 17 will drive the driving wheel 132, which then drives the flywheel 134 to rotate.

Modifications, equivalents, and variations may be made to the above embodiment by a person having ordinary skill in the art, and those modifications, equivalents, and variations are within the scope of the present invention. For example, each link rod 16 may couple with the front or rear portion instead of the middle portion of the second swing arm 12. In another embodiment, each first swing arm 11 couples with an end of a second swing arm 12, the other end of the second swing arm couples to an end of a third swing arm (not shown), and the other end of the third swing arm couples to a pedal 17. In another embodiment, the exercise device comprises two swing-arm sets, and each swing-arm set comprises two or more swing arms, e.g., the above-mentioned first swing arm 11 and second swing arm 12, or the above-mentioned first swing arm, second swing arm, and third swing arm. They are coupled one by one, with a front end couples with the frame 10 and a rear end couples with a pedal 17.

Figure 1B:
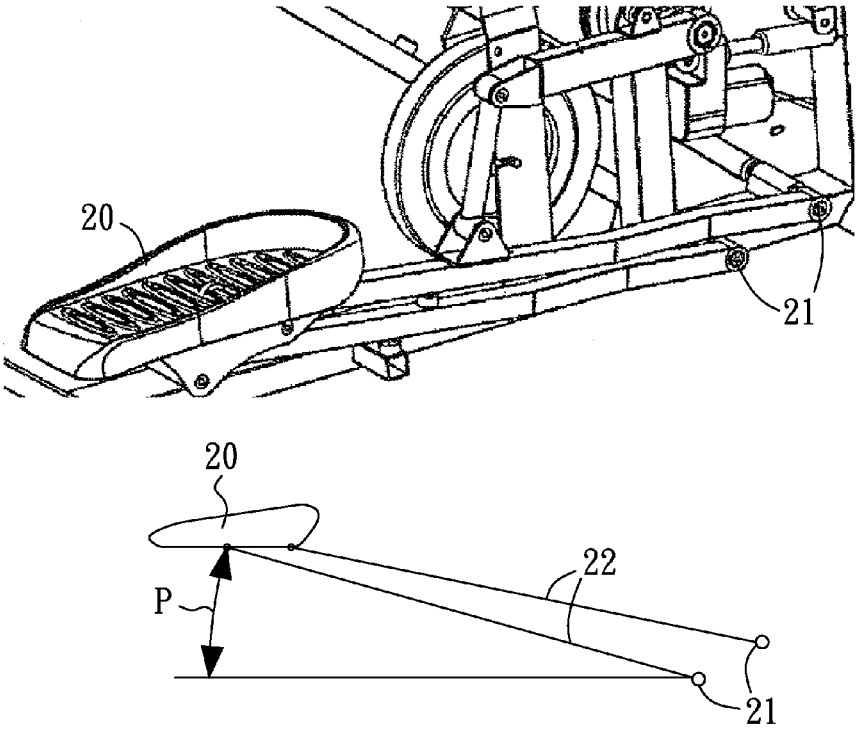
FIG.1B(Prior Art)
Figure 3:
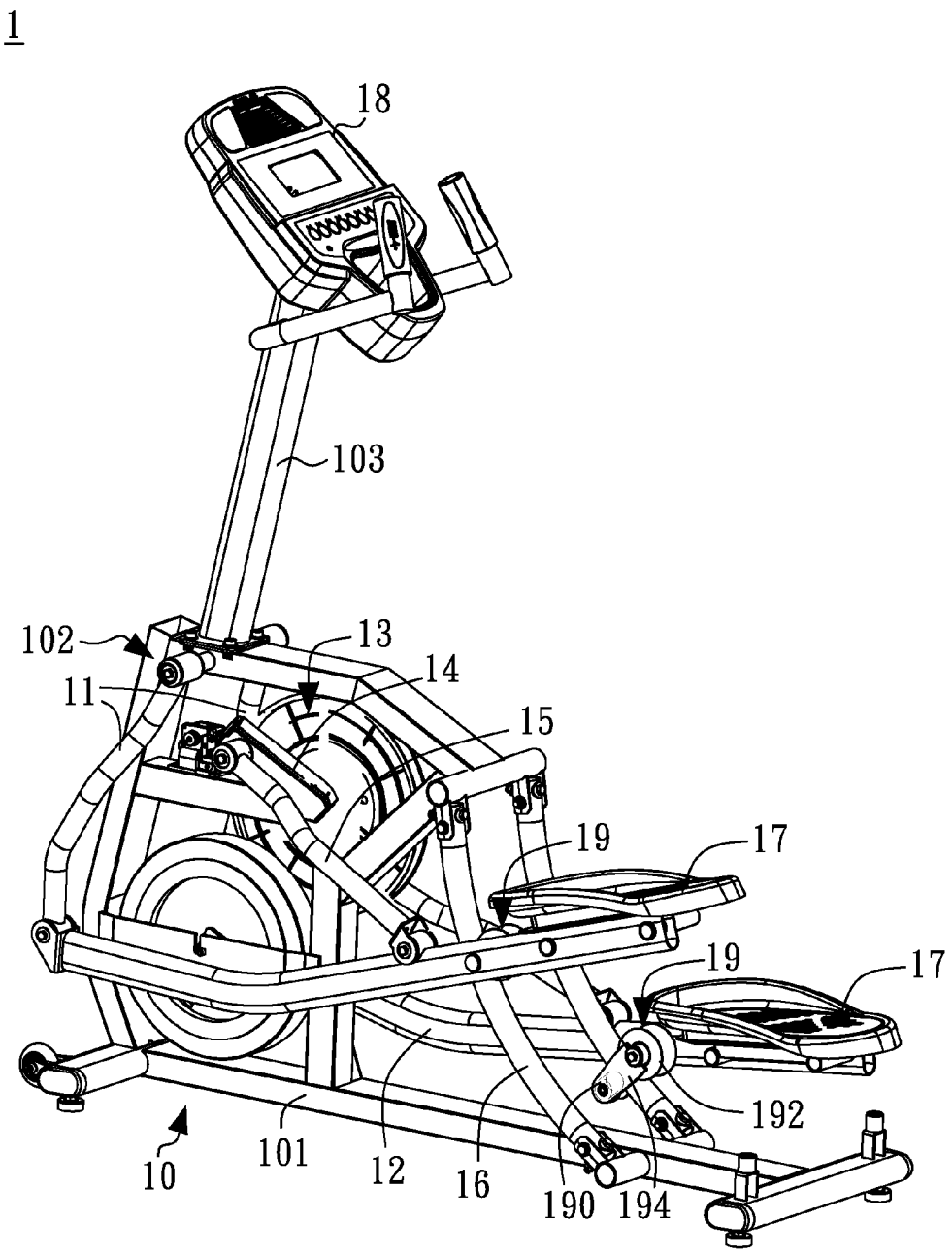
FIG. 3 is a perspective view showing the operation of the exercise device of FIG. 1.
Figure 4:
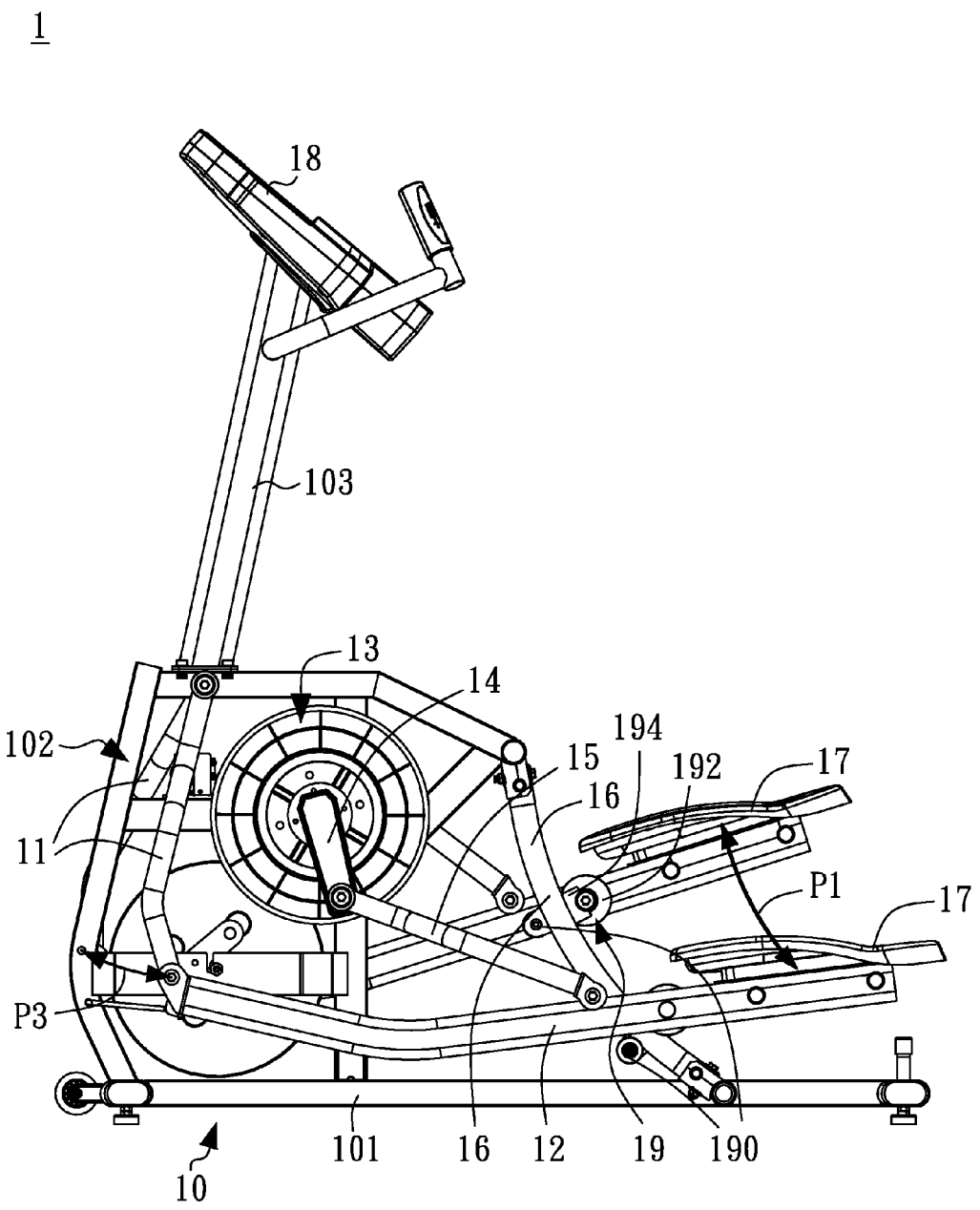
FIG. 4 is a side view showing the operation of the exercise device of FIG. 1.

FIGS. 3 and 4 are perspective and side view, respectively, showing the operation of the exercise device 1 of FIG. 1. Referring to FIG. 3, when the crank 14 is operated to overlap the link rod 15, the two pedals 16 are not at the highest and lowest positions, so that the "dead point" problem can be avoid and the cranks 14 can be further moved. Referring to FIG. 4, when the exercise device is operated, the first swing arm 11 will drag the second swing arm 12 moving along a reciprocal moving path P3. Referring to FIG. 4, the moving path P of the each pedal 17 of the exercise device 1 is an arc with a center toward the user. Compared with the conventional non-ergonomic moving path, the moving path P of the present invention is ergonomic. In addition, because the cranks 14 directly exert force to the second swing arms 12, the climbing force given to the pedals 17 will be sufficient and strong. With the strong climbing force and ergonomic moving path, the stepping, striding, or stair-climbing exercises can be realistically simulated. Furthermore, the moving path is smooth and the user will feel unhindered when operating the exercise device.

Figure 5:
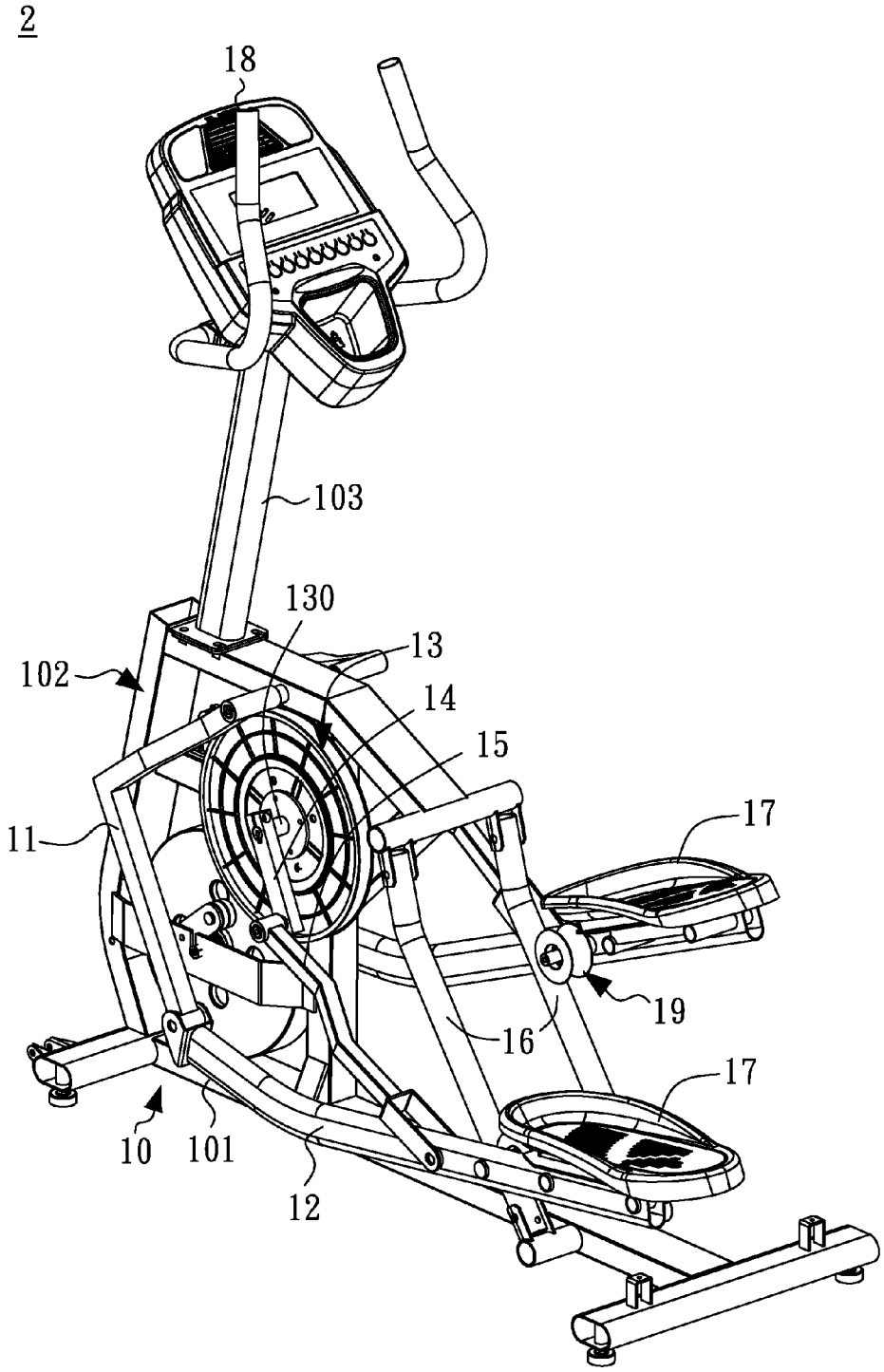
FIG. 5 is a perspective view showing an exercise device according to another embodiment of the present invention.
Figure 6:
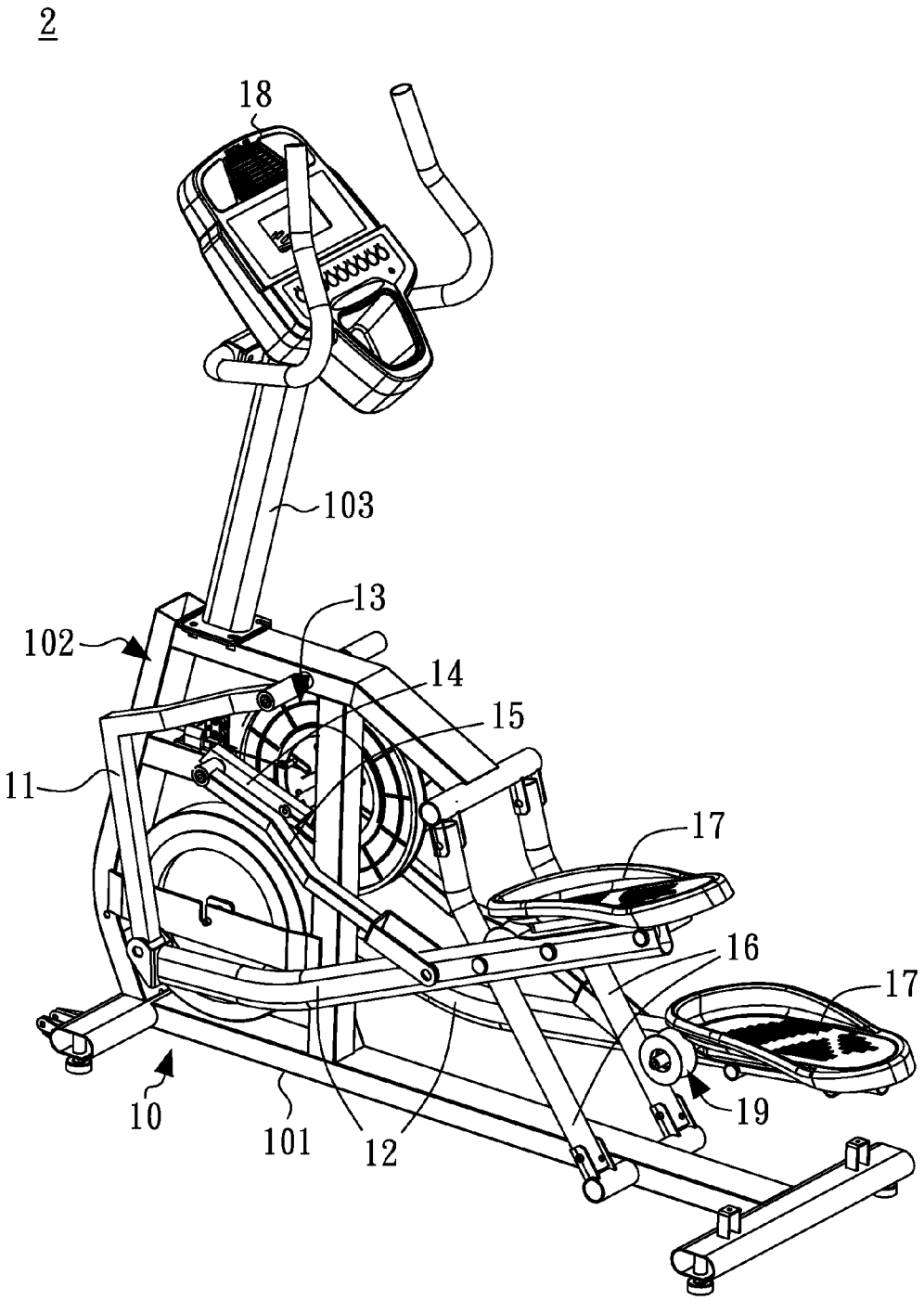
FIG. 6 is a perspective view showing the operation of the exercise device of FIG. 5.
Figure 7:
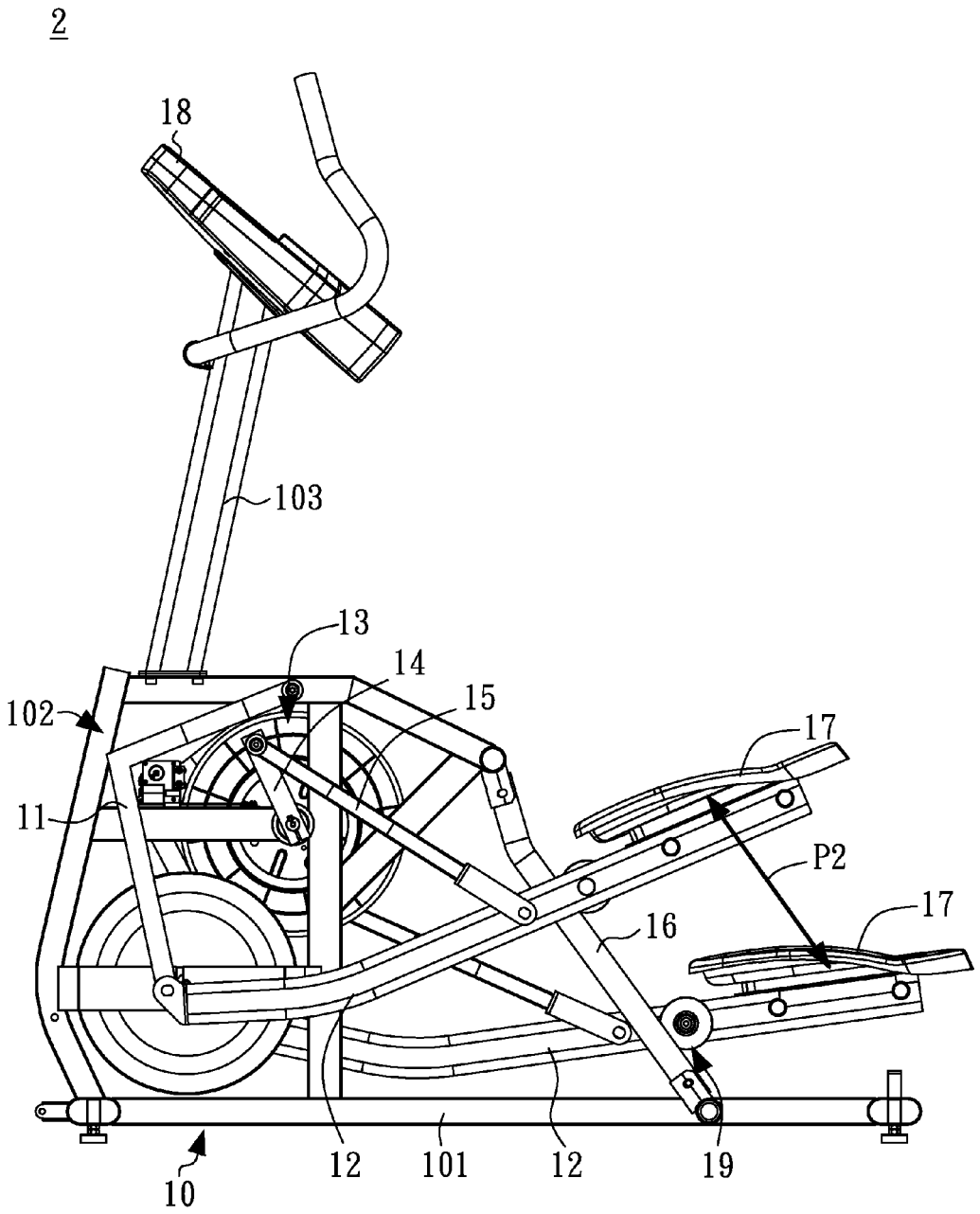
FIG. 7 is a side view showing the operation of the exercise device of FIG. 5.

FIG. 5 is a perspective view showing an exercise device 2 in accordance of another embodiment of the present invention. The exercise device 2 has similar features as the exercise device 1, and the difference between them is the liming rods 16. In this embodiment, each of the limiting rods 16 has a straight configuration instead of an arc configuration. FIGS. 6 and 7 are perspective and side view, respectively, showing the operation of the exercise 2 and the moving paths P2 of the pedals. In detail, when the pedal 17 is moved to the lowest position, the rear portion of the pedal 17 will be lifted a bit or the whole pedal 17 is near horizontal. When the pedal 17 is moved to the highest position, the rear portion of the pedal 17 will be lifted considerably. This moving path is quite ergonomic for simulating stepping, striding, or stair-climbing, and therefore the user can operate the exercise devise easily and safely. Referring to FIG. 6, when the crank 16 is operated to overlap with the link rod 15, the pedals 17 are at neither the highest position nor the lowest position, so that the cranks 14 can be further moved and thus the dead point is absent. Referring to FIG. 7, the moving path P of the pedals 17 is an oblique line and ergonomic so that the user can operate efficiently and safely.

The intent accompanying this disclosure is to have each/all embodiments construed in conjunction with the knowledge of one skilled in the art to cover all modifications, variations, combinations, permutations, omissions, substitutions, alternatives, and equivalents of the embodiments, to the extent not mutually exclusive, as may fall within the spirit and scope of the invention. Corresponding or related structure and methods disclosed or referenced herein, and/or in any and all co-pending, abandoned or patented application(s) by any of the named inventor(s) or assignee(s) of this application and invention, are incorporated herein by reference in their entireties, wherein such incorporation includes corresponding or related structure (and modifications thereof) which may be, in whole or in part, (i) operable and/or constructed with, (ii) modified by one skilled in the art to be operable and/or constructed with, and/or (iii) implemented/made/used with or in combination with, any part(s) of the present invention according to this disclosure, that of the application and references cited therein, and the knowledge and judgment of one skilled in the art.

Conditional language, such as, among others, "can," "could," "might," or "may," unless specifically stated otherwise, or otherwise understood within the context as used, is generally intended to convey that embodiments include, and in other interpretations do not include, certain features, elements and/or steps. Thus, such conditional language is not generally intended to imply that features, elements and/or steps are in any way required for one or more embodiments, or interpretations thereof, or that one or more embodiments necessarily include logic for deciding, with or without user input or prompting, whether these features, elements and/or steps are included or are to be performed in any particular embodiment.

All of the contents of the preceding documents are incorporated herein by reference in their entireties. Although the disclosure herein refers to certain illustrated embodiments, it is to be understood that these embodiments have been presented by way of example rather than limitation. For example, any of the particulars or features set out or referenced herein, or other features, including method steps and techniques, may be used with any other structure(s) and process described or referenced herein, in whole or in part, in any combination or permutation as a non-equivalent, separate, non-interchangeable aspect of this invention. Corresponding or related structure and methods specifically contemplated and disclosed herein as part of this invention, to the extent not mutually inconsistent as will be apparent from the context, this specification, and the knowledge of one skilled in the art, including, modifications thereto, which may be, in whole or in part, (i) operable and/or constructed with, (ii) modified by one skilled in the art to be operable and/or constructed with, and/or (iii) implemented/made/used with or in combination with, any parts of the present invention according to this disclosure, include: (I) any one or more parts of the above disclosed or referenced structure and methods and/or (II) subject matter of any one or more of the inventive concepts set forth herein and parts thereof, in any permutation and/or combination, include the subject matter of any one or more of the mentioned features and aspects, in any permutation and/or combination.

Although specific embodiments have been illustrated and described, it will be appreciated by those skilled in the art that various modifications may be made without departing from the scope of the present invention, which is intended to be limited solely by the appended claims.

What is claimed is:

1. An exercise device, comprising:

a frame;

two pedals, enabling force to be applied;

two first swing arms, respectively arranged at a side of the frame, each first swing arm having a first end and a second end, said first end of said two first swing arms pivotally coupling to the frame;

two second swing arms, each second swing arm having a first end and a second end, said first end of said two second swing arms coupling to said second end of said two first swing arms, said second end of said two second swing arms coupling to said two pedals;

a resistance device pivoted to the frame by an axle;

two cranks, respectively arranged at a side of said resistance device, each crank having a first end and a second end, said first end of said two cranks coupling to said axle;

two link rods, each link rod having a first end and a second end, said first end of said two link rods coupling to said second end of said two cranks, said second end of said two link rods pivoting on an area of said two second swing arms between said first end and said second end of said second swing arms;

two limiting rods, respectively arranged at a side of the frame, each limiting rod having a first end and a second end, said first end and said second end of said two limiting rod coupling to the frame; and two roller assemblies, respectively coupling to said two second swing arms and slidably coupling to said two limiting rods;

whereby each of the pedals moves along a reciprocal linear or arc moving path.

2. The exercise device of claim 1, wherein each roller assembly comprises a front roller, a board structure, and a rear roller, the front roller and the rear roller are pivotally coupled with the board structure and are respectively arranged at a front and a rear of the corresponded limiting rod.

3. The exercise device of claim 2, wherein both the front roller and the rear roller have a recess to fit the corresponded limiting rod.

4. The exercise device of claim 2, wherein each limiting rod is arc-shaped, and each roller assembly has an inclination varied along the corresponded limiting rod.

5. The exercise device of claim 1, wherein each limiting rod is arc-shaped with a center toward a user of the exercise device.

6. The exercise device of claim 1, wherein each limiting rod is straight-shaped.

7. The exercise device of claim 1, wherein the frame comprises:

a base arranged on a supporting plane or ground; and a supporting structure arranged on the base, wherein said first end of said two limiting rods couples to said supporting structure and said second end of said two limiting rods couples to said base.

8. The exercise device of claim 1, wherein each pedal has an inclination, and the inclination of the pedal at the lowest position is smaller the inclination of the pedal at the highest position.

* * * * *